United States Patent [19]

Bailey

[11] 4,352,283

[45] Oct. 5, 1982

[54] METHOD OF FORMING SPARK PLUG BODIES

[75] Inventor: Robert J. Bailey, Enfield, England

[73] Assignee: Ford Motor Company, Dearborn, Mich.

[21] Appl. No.: 241,145

[22] Filed: Mar. 6, 1981

[51] Int. Cl.[3] ..... B21D 22/00

[52] U.S. Cl. ..... 72/354; 72/356; 72/358; 72/370; 72/377

[58] Field of Search ..... 72/354, 356, 377, 378, 72/352, 370, 358

[56] References Cited

U.S. PATENT DOCUMENTS

| | | | |
|---|---|---|---|
| 3,101,534 | 8/1963 | Lange | 72/356 X |
| 3,122,831 | 3/1964 | Bailey et al. | 72/356 X |
| 3,186,209 | 6/1965 | Friedman | 72/356 X |
| 3,188,849 | 6/1965 | Wisebaker | 72/356 X |
| 3,491,576 | 1/1970 | Oguri | 72/356 |
| 3,974,677 | 8/1976 | Caslellani | 72/356 |
| 4,094,183 | 6/1978 | Meltler | 72/356 |
| 4,291,568 | 9/1981 | Stifano | 72/356 |

*Primary Examiner*—Leon Gilden

*Attorney, Agent, or Firm*—Paul K. Godwin, Jr.; Clifford L. Sadler

[57] ABSTRACT

A method of manufacturing a hollow spark plug body having a cylindrical central portion (28), a first end portion (10) of smaller circular radial cross-section and a second end portion of non-circular radial cross-section, e.g. hexagonal, and of smaller maximum diameter than the central portion by cold extruding the both end portions. The second end portion is extruded in two stages, the first involving the formation of a recess in one end of a cylindrical blank, the second involving extrusion the blank between a die (19) and a mandrel (21) which moves with the blank during extrusion.

4 Claims, 10 Drawing Figures

METHOD OF FORMING SPARK PLUG BODIES

DESCRIPTION

This invention relates to a method of manufacturing spark plug bodies.

Conventional spark plug bodies comprise a central, usually cylindrical, portion, defining a radial flange for sealing the body to an aperture in an engine, a lower cylindrical portion which is formed with a thread, and an upper portion of non-circular, usually hexagonal, radical cross section which is adapted to be engaged by a wrench.

In most spark plugs, the upper portion has a larger maximum diameter than the central portion, which is in turn of larger diameter than the lower portion. Since the widest part of the body is positioned at its upper end, such bodies can easily be manufactured using a cold extrusion process in which a metal blank is subjected to a sequence of forward extrusion steps in a set of dies of gradually decreasing diameters.

In some circumstances however, it is desirable that the upper portion of the body should be of smaller maximum diameter than the central portion. For example, in some engines the spark plug is positioned in a recess in the engine head. A smaller diameter upper portion facilitates access to the spark plug with a wrench.

Hitherto such spark plug bodies have been manufactured by cold extrusion of a blank to produce the smaller-diameter lower portion and then forming the upper portion thereon by a machining operation. Since the upper portion is usually of hexagonal radial cross-sectional, such a maching operation is relatively expensive to perform, especially as a large scale production process.

According to the present invention there is provided a method of manufacturing a spark plug body comprising the steps of shaping a cylindrical blank by cold extrusion to produce an axially elongated hollow body having a cylindrical central portion, and a first end portion having a circular radial cross-section of smaller diameter than the central portion, and forming on the opposite end a second end portion of non-circular radical cross-section of smaller maximum diameter than the central portion, characterised in that the second end portion is also formed by cold extrusion.

The second end portion is preferably formed in two cold extrusion steps. In the first step, the blank is extruded to form a recess in one end of the blank without decreasing the external diameter of the blank in the region of the recess. This recess is preferably formed to a depth sufficient to provide enough material in the walls of the recess for the formation of the second end portion and the central portion, leaving enough material for the formation of the first end portion in the remainder of the blank. In the second extrusion step, the external diameter of the recessed end of the blank is reduced and formed into a non-circular cross-sectional shape, without decreasing the internal diameter of the recess. This is conveniently achieved by extruding the recessed end of the blank between a die and a mandrel positioned in the recess. In order to prevent the material from the other end of the blank from flowing over the mandrel, the mandrel is preferably movable relative to the die in the direction in which the blank is extruded. Where the die is to be used repeatedly, the mandrel is preferably movable relative to the die against the bias of means, such as a compression spring, which restores the mandrel to a starting position relative to the die when a formed blank has been removed from the die.

The first end portion is preferably also formed in a two step process. In the first step the end of the blank is cold extruded to produce a solid cylindrical tail portion of reduced diameter. In the second stage a recess is formed within the tail portion. This recess is of depth sufficient to form a cylindrical end portion of the required length so that the centre of the end portion can be punched out to produce a passage through the spark plug body for receiving an insulator. The tail portion is preferably formed in an initial cold extrusion step carried out on the blank.

A preferred embodiment of the invention will now be described, by way of example only with reference to the accompanying schematic drawings in which.

Referring to FIGS. 1 to 8, a cylindrical blank is cut from a circular-section bar of steel and is subjected to a series of cold extrusions in a six-stage cold forming press. The press includes a linear array of six cold extrusion stations each of which has a die and a plunger, for forcing a blank into the die, the plungers being positioned on one side of the machine and the dies being positioned on the other side of the machine. A transfer mechanism operates to index blanks cut from the steel bar successively through the six stations.

Figure 3:
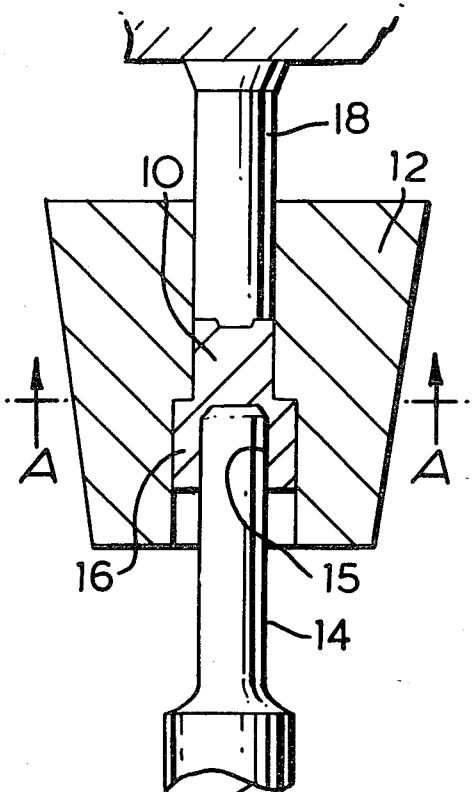
FIGS. 1 to 8 represent axial cross-sections through a series of dies in which a blank is successively cold extruded in accordance with the method of the invention.
Figure 2:
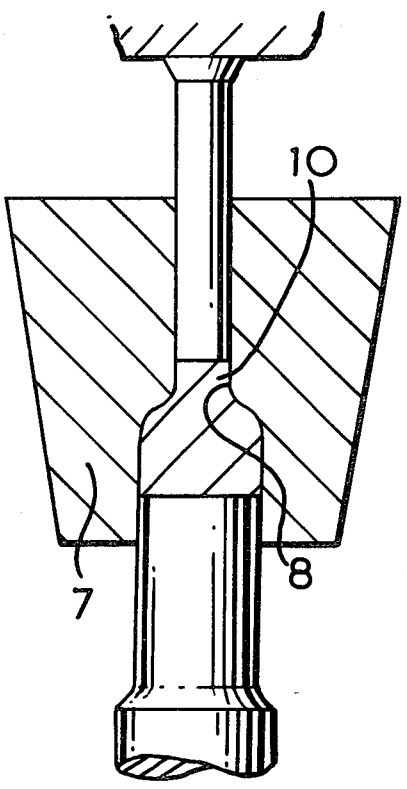
Figure 1:
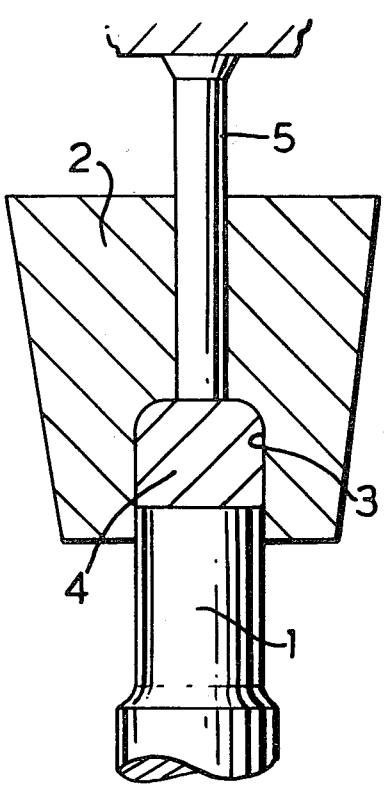
Figure 6:
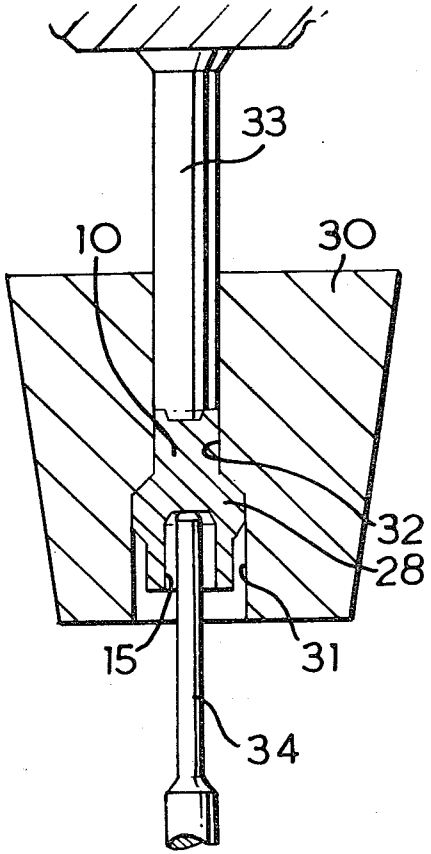

In the first station, illustrated in FIG. 1, the plunger 1 forces a cylindrical blank cut from the bar of steel into a first die 2 having cylindrical recess 3, the inner end of which is domed. The resulting bullet-shaped blank 4 is removed from the first die by means of a knock-out pin 5, which is held rigid during the movement of the plunger 1 into the die 2, and is transferred to a die 7 (FIG. 2) in the second station by the transfer mechanism (not shown).

In the second die 7, the bullet shaped blank is subjected to forward extrusion into a cylindrical recess 8 in the inner end of the die cavity 9 to partly form a solid cylindrical tail portion 10 on the blank of reduced diameter. The blank 4 is then transferred into a die 12 in the third station (FIG. 3) and subjected to cold extrusion therein by the plunger 14. The plunger 14 forms a recess 15 in one end 16 of the blank 4 by backward extrusion and elongates the tail portion 10. The extrusion also results in a slight "heading" or increase in the diameter of the blank 4.

The recess 15 is formed in the blank to a depth sufficient to provide enough material in the walls 16 of the recess 15 (i.e. below the line A—A in FIG. 3) for all subsequent forming operations on the main body part of the blank, and to leave sufficient material in the tail portion 10 for all subsequent forming operations thereon. That is to say, during all the subsequent forming operations no material is extruded across line A—A in FIG. 3 in either direction.

The blank 4 is then removed from the third die 12 by a knock-out pin 18 and transferred into a die 19 (FIG. 4) in the fourth station. During this transfer the blank 4 is inverted relative to the dies.

Figure 5:
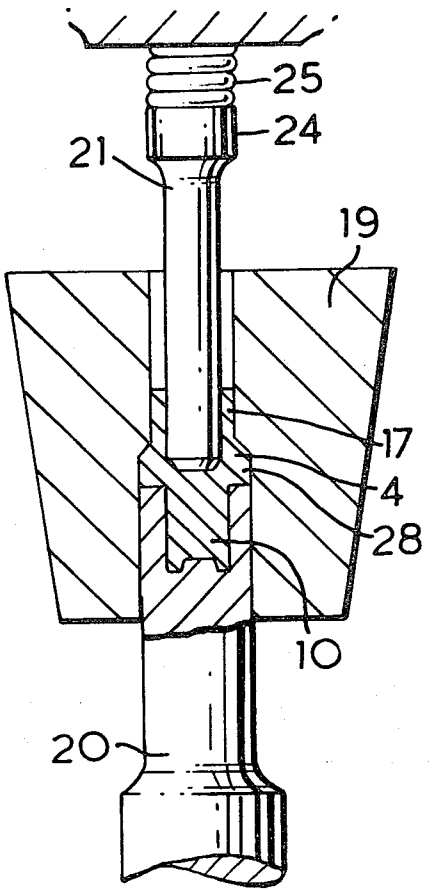
Figure 4:
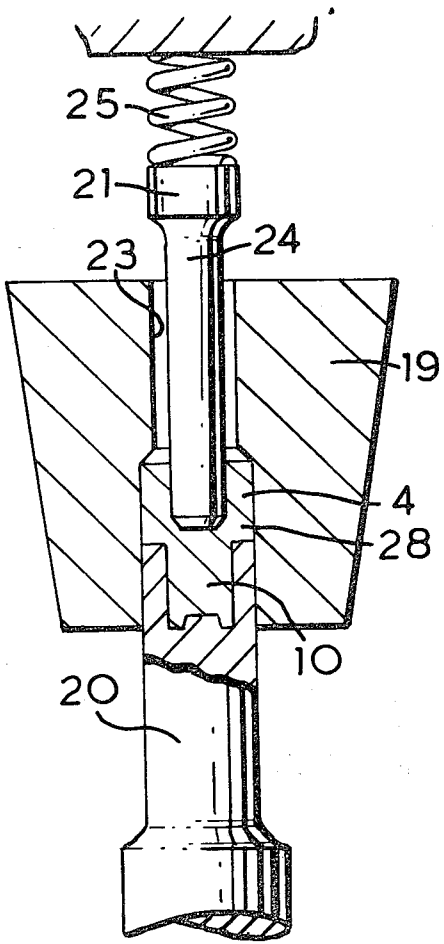

FIG. 4 illustrates the relative configuration of the fourth die 19, the plunger 20, knock-out pin 21 and blank 4 at the beginning of the working part of the stroke of the plunger 20, and FIG. 5 illustrated their configuration at the end of the stroke.

The plunger 20 includes a central recess having of complementary cross-section to the tail portion 10 of the blank 4. The die 19 includes a main cylindrical recess for receiving the recessed end of the blank 4 and a coaxial passage 23 of hexagonal radical cross-section in which a mandrel 24 is centrally positioned. The mandrel 24 is movable axially relative to the die 19 and is biased into the passage 23 by means of a compression spring 25.

As the plunger executes its working stroke, the recessed end of the blank 4 is forward extruded into the passage 23 around the mandrel 24 so that the maximum external diameter of the recessed end 17 of the blank 4 is reduced, but the internal diameter of the recess 15 is kept constant.

During the working stroke of the plunger 19, the mandrel 24 moves upwardly (as seen in FIGS. 4 and 5) relative to the die so that its position relative to the tail portion 10 of the blank 4 remains unaltered. The quantity of material in the central portion 28 of the blank 4 thus remains unaltered.

The blank 4 is then transferred to a die 30 in the fifth station and is gain inverted relative to the dies during this transfer. The fifth die 30 contains a main cylindrical bore 31 having a diameter equal to that of the central portion 28 of the blank 4, and cylindrical extension 32 at the end thereof receiving the tail portion 10 and closed by a knock-out pin 33 which remains fixed during the working part of the stroke of the plunger 34.

Figure 7:
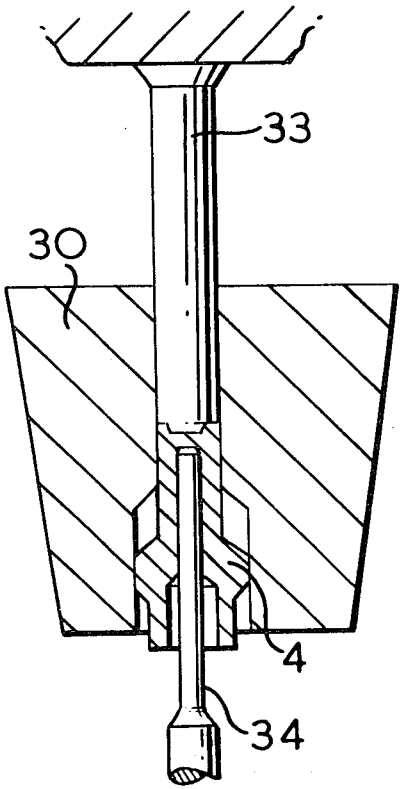

The plunger 34 is of smaller diameter than the recess 15 and, when pressed into the blank 4 causes backward extrusion of the tail portion 10 of the blank to form a recess 38 therein, as illustrated in FIG. 7.

The blank 4 is then transferred to a sixth station containing a die 40 having a recess similar to that of the die in the fifth station. However the tail 10 of the blank 4 abuts a hollow knock-out pin 42 having a central axial passage 43. The plunger 44 is of smaller diameter than the recess 38 in the tail portion 10 so that, when actuated, the plunger 44 punches out the end of the tail portion 10 to produce an axial passage through the blank.

Figure 9:
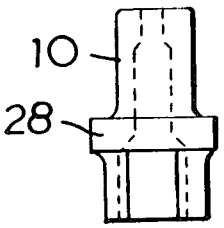
FIG. 9 is a elevation of a blank which has been cold extruded in the dies illustrated in FIGS. 1 to 8.
Figure 10:
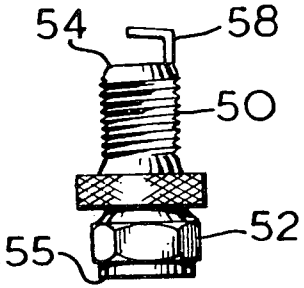
FIG. 10 is an elevation of a finished spark plug body produced from the extruded blank of FIG. 9.
Figure 8:
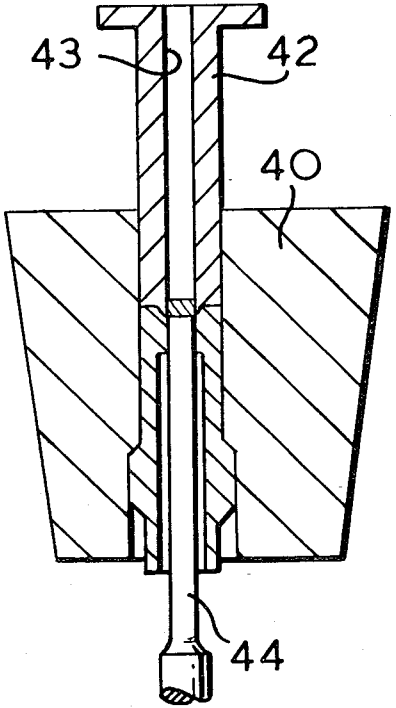

The shaped blank 4, illustrated in FIG. 9 is then subjected to a finishing treatment in which a thread 50 is rolled on the exterior of the tail portion 10, the hexagonal end portion is undercut to form a hexagonal head 52, the ends 54, 55 of the blank 4 are milled smooth, and a side electrode 58 is welded on to the end of the tail portion 10. The body is then ready for assembly into a spark plug.

The process described above therefore permits a non-circular, e.g. hexagonal end to be formed on the spark plug body which, like the tail portion 10, has a maximum diameter smaller than that of the central portion 28 of the body by means of a cold extrustion process which avoids complicated milling operations.

I claim:

1. A method of cold extruding a spark plug body having a cylindrically shaped central portion, a cylindrically shaped first end portion with a diameter less than said central portion and a hexagonally shaped second end portion with a maximum cross-sectional measurement less than the diameter of said central portion comprising the steps of:

forcing a steel blank into a first cylindrical die to shape said blank into a cylindrical blank of a first diameter and having first and second defined ends;

forcing said first end of said cylindrical blank into a second cylindrical die to form a first cylindrically shaped end portion having a second diameter that is less than said first diameter; and forcing said second end of said cylindrical blank into a hexagonally shaped die and around a biased mandrel to form a hollow hexagonally shaped portion thereon having a maximum cross-sectional measurement that is less than said first diameter.

2. A method as in claim 1, wherein said step of forcing said first end of said cylindrical blank to form said first cylindrically shaped end portion is performed by utilizing a plunger that is forcibly penetrated into said second end of said cylindrical blank to thereby cause extrusion of said first end in said second cylindrical die to form said first end portion and a hollow second end portion.

3. A method as in claim 2, wherein said step of forcing said second end of said cylindrical blank into a hexagonally shaped die is performed by extending a spring biased mandrel into said hollow second end and utilizing a plunger having a cross-sectional diameter corresponding to said first diameter and having an end face that conforms to the entire first end of said cylindrical blank including said first end portion to forcibly extrude and lengthen said second end portion into said hexagonally shaped die.

4. A method as in claim 3, further including the step of cutting a helical thread on the external surface of said first end portion.

* * * * *